US008136597B2

(12) United States Patent
Calderoni et al.

(10) Patent No.: US 8,136,597 B2
(45) Date of Patent: Mar. 20, 2012

(54) METHOD AND SYSTEM FOR THE EXTINCTION OF AN UNDERWATER WELL FOR THE EXTRACTION OF HYDROCARBONS UNDER UNCONTROLLED FLUID DISCHARGE CONDITIONS

(75) Inventors: Angelo Calderoni, San Donato Milanese (IT); Paolo Ferrara, Milan (IT)

(73) Assignee: Eni S.p.A., Rome (IT)

( * ) Notice: Subject to any disclaimer, the term of this patent is extended or adjusted under 35 U.S.C. 154(b) by 0 days.

(21) Appl. No.: 12/936,625

(22) PCT Filed: Apr. 6, 2009

(86) PCT No.: PCT/IB2009/005253

§ 371 (c)(1),
(2), (4) Date: Oct. 6, 2010

(87) PCT Pub. No.: WO2009/125293

PCT Pub. Date: Oct. 15, 2009

(65) Prior Publication Data

US 2011/0056697 A1 Mar. 10, 2011

(30) Foreign Application Priority Data

Apr. 7, 2008 (IT) ..... MI2008A0602

(51) Int. Cl.
*E21B 7/12* (2006.01)

(52) U.S. Cl. ..... 166/343; 166/250.01; 166/250.08; 701/21

(58) Field of Classification Search ..... 166/92.1, 166/97.1, 75.13, 77.1, 93.1, 96.1, 339, 337, 166/343, 250.01, 250.08; 405/154.1, 158, 405/184.4; 701/21

See application file for complete search history.

(56) References Cited

U.S. PATENT DOCUMENTS 3,643,741 A * 2/1972 Miranda ..... 166/295

(Continued)

FOREIGN PATENT DOCUMENTS

GB 2 061 109 5/1981

(Continued)

OTHER PUBLICATIONS

International Search Report issued Feb. 5, 2010 in PCT/IB09/005253 filed Apr. 6, 2009.

*Primary Examiner* — Thomas Beach
*Assistant Examiner* — Aaron Lembo
(74) *Attorney, Agent, or Firm* — Oblon, Spivak, McClelland, Maier & Neustadt, L.L.P.

(57) ABSTRACT

A method for the extinction or oil well-killing or killing of an underwater well for the extraction of hydrocarbons under uncontrolled fluid discharge conditions, also called blowout, by assembling, in correspondence with the lower end portion of a string of pipes for the extinction or killing string, a constraint group for rigid connection between a plurality of remote-operated underwater vehicles and the killing string; detecting the position of a flow of fluids and positioning the killing string substantially in correspondence with said flow; lowering a plurality of remote-operated vehicles close to the lower end portion of the killing string; connecting the remote-operated vehicles to the constraint group; detecting in real time the relative position of the flow of fluids with respect to the vehicles and calculating the position of the outlet hole of the flow; on the basis of the calculated position of the outlet hole, coordinately piloting the vehicles so as to bring the lower end of the string in correspondence with the position of the outlet hole of the flow.

15 Claims, 4 Drawing Sheets

U.S. PATENT DOCUMENTS

| | | | | |
|---|---|---|---|---|
| 4,324,505 | A | 4/1982 | Hammett | |
| 4,336,843 | A * | 6/1982 | Petty | 166/353 |
| 4,382,716 | A | 5/1983 | Miller | |
| 4,543,817 | A * | 10/1985 | Sugiyama | 73/40.5 A |
| 4,568,220 | A * | 2/1986 | Hickey | 405/60 |
| 5,263,796 | A * | 11/1993 | de Waal | 405/172 |
| 5,675,506 | A * | 10/1997 | Savic | 702/51 |
| 6,615,923 | B1 * | 9/2003 | Lay et al. | 166/368 |
| 6,763,889 | B2 * | 7/2004 | Rytlewski et al. | 166/338 |
| 6,771,563 | B1 | 8/2004 | Bernard | |
| 6,865,139 | B2 * | 3/2005 | Hudson | 367/131 |
| 7,417,923 | B2 * | 8/2008 | Greelish | 367/129 |
| 7,926,438 | B2 * | 4/2011 | Guerrero et al. | 114/312 |
| 2004/0233784 | A1 | 11/2004 | Bernard | |
| 2007/0104031 | A1 | 5/2007 | Bernard | |
| 2009/0255680 | A1 * | 10/2009 | Maxwell | 166/339 |
| 2011/0093138 | A1 * | 4/2011 | Ferrara et al. | 701/2 |
| 2011/0240303 | A1 * | 10/2011 | Hallundbaek | 166/339 |

FOREIGN PATENT DOCUMENTS

| | | |
|---|---|---|
| WO | 01 70568 | 9/2001 |

* cited by examiner

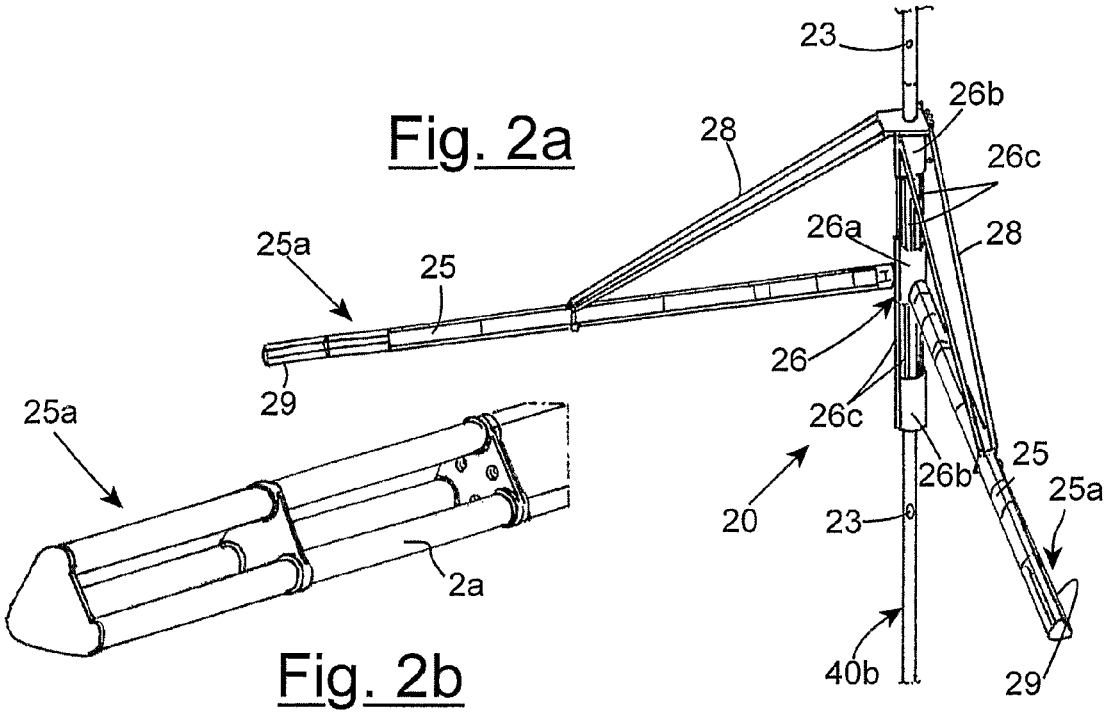
Fig. 2a
Fig. 2b
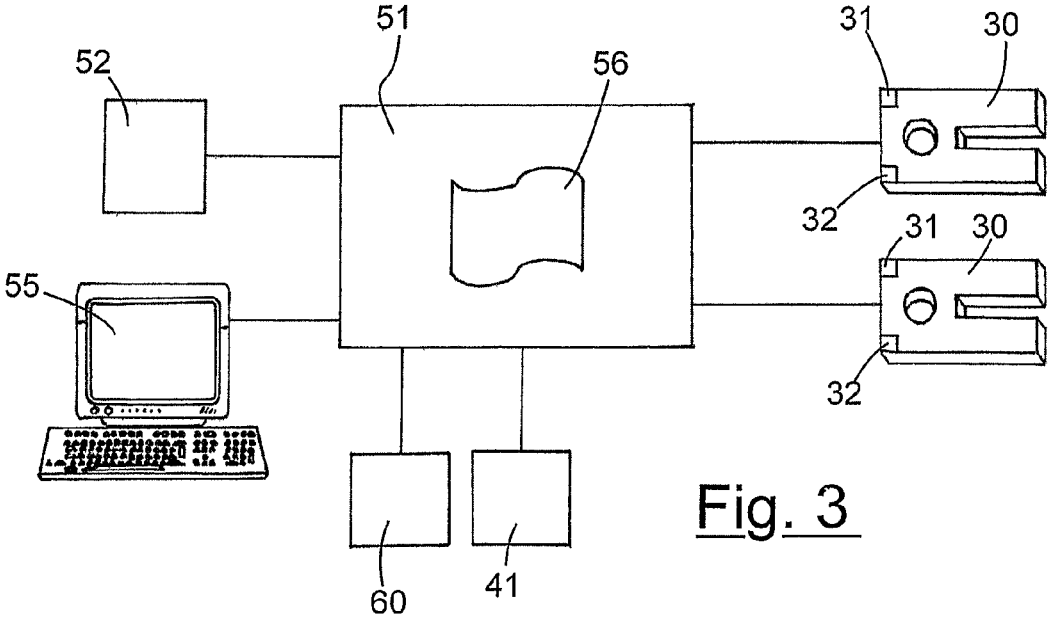
Fig. 3

METHOD AND SYSTEM FOR THE EXTINCTION OF AN UNDERWATER WELL FOR THE EXTRACTION OF HYDROCARBONS UNDER UNCONTROLLED FLUID DISCHARGE CONDITIONS

The present invention relates to a method and system for the extinction or oil well killing or killing of an underwater well for the extraction of hydrocarbons under uncontrolled fluid discharge conditions, also called blowout.

In the field of underwater drilling, the wells are kept under control by means of a column of mud which provides a hydrostatic load sufficient for maintaining overpressure between the well and the external pressure at controlled values. This column of mud, also known as primary well control barrier, is present both inside the well and also in a pipe called riser which connects the drilling plant to the sea bottom.

At the sea bottom, moreover, in correspondence with the well heads, there are generally secondary well control devices, called blowout preventers or BOP, which act as valves and can close the well in the case of uncontrolled discharges of fluids from the well itself.

In case of breakage of the riser, for example, with the consequent loss of static load of the column of mud present in the riser, which is typically higher than the static load due to the sea depth, the BOPs are closed. This operation prevents the well from entering into a blowout condition.

In rare cases, generally due to exceptional natural events, such as a solution, there can be the accidental removal of both the riser and the BOPs installed at the sea bottom, making it impossible to prevent the well from entering into a blowout condition. Analogously, blowout accidents can also occur before the installation of the BOPs.

Although these events are rare, they can have very serious consequences in terms of personal safety, environmental pollution and well restoration costs.

In the case of the blowout of an underwater well, it is currently possible to use various techniques for reestablishing the control of the well, such as for example bridging, capping, the production of a relief well and the extinction or killing, by means of a string of pipes for the extinction, called killing string.

Bridging is an uncontrollable event, as it involves the spontaneous collapsing of the well in blowout which generally occurs in the presence of wide sections of uncovered hole.

Capping is a valve-closing technique widely used in onshore blowouts, but it is difficult to apply underwater, especially at great depths.

The production of a relief well is the safest and most widely-used technique at present, but requires extremely long times, in the order of months, and very high costs.

A killing intervention consists in the insertion of a specific string of pipes for the extinction (killing string) inside a blowout well. When inserted in the well, the killing string allows conventional killing techniques to be applied such as the circulation of heavy mud, closure by means of inflatable packers, and so forth.

This method has proved to be the most rapid, but it can currently only be used in the case of well blowouts in shallow water, i.e. less than 1,000 m. In this case, on the one hand, there are reasonable underwater visibility conditions, and on the other, it is possible to quite easily move the killing string with the drilling plant, in particular by restoring the underwater anchoring systems, also called guidelines.

In deep water applications, i.e. for depths greater than 1,000 m, the drilling is effected with the use of a drill ship having a dynamic positioning, whose instantaneous position is controlled by means of global positioning systems or GPS.

In the case of deep water well blowouts, the killing operation must consequently be effected with this ship. This creates various technical problems in particular linked with the reinsertion of the killing string inside the blowout well: the errors in the dynamic positioning of the drill ship, the sea currents, the currents induced by the blowout flow, also called plume, and the pressure of the plume itself at the well outlet make it difficult to control the head of the killing string from the ship.

The reinsertion operation of the killing string in the well requires positioning precision in the order of about ten centimeters.

The systems currently used for indicating the position of the well on the sea bottom, based on a plurality of transponders, are not able to offer this precision when they are also functioning in the presence of uncontrolled fluid discharges.

In addition to the above, there are also conditions of poor visibility caused by the turbulences induced by the plume on the sea bottom. The known optical systems connected at the bottom of the killing string are consequently also insufficient for revealing the discharge point of the blowout.

Furthermore, in order to also keep the positioning system of the killing string outside the plume, at the same time mechanically keeping it connected with the same, the string must be guided from a safety distance.

The positioning system must consequently comprise more than one application point of the guiding forces to minimize the forces and moments to be transmitted to the string and keep them on the vertical of the well.

There are currently no known underwater positioning systems which satisfy these characteristics.

The above considered, in case of operations with a drill ship with dynamic positioning, at great water depths, the use of a string of pipes for the killing of a well under uncontrolled fluid discharge conditions is practically unfeasible at the present.

An objective of the present invention is to overcome the above drawbacks and in particular to provide a method and system for the killing of an underwater well for the extraction of hydrocarbons under uncontrolled fluid discharge conditions, which allows a killing string to be used also when the well is situated at great water depths.

A further objective of the present invention is to provide a method and system for the killing of an underwater well for the extraction of hydrocarbons under uncontrolled fluid discharge conditions, which makes it possible to guide the insertion of the killing string towards the well in blowout with a high precision and offering sufficient operating safety.

Another objective of the present invention is to provide a method and system for the killing of an underwater well for the extraction of hydrocarbons under uncontrolled fluid discharge conditions, which envisages the use of instrumentation generally available on the drill ship currently used.

These and other objectives according to the present invention are achieved by providing a method and system for the killing of an underwater well for the extraction of hydrocarbons under uncontrolled fluid discharge conditions, as specified in the independent claims.

Further characteristics of the device are object of the dependent claims.

The characteristics and advantages of a method and system for the killing of an underwater well for the extraction of hydrocarbons under uncontrolled fluid discharge conditions according to the present invention will appear more evident from the following illustrative and non-limiting description, referring to the enclosed schematic drawings in which:

FIG. 1*a* is a schematic representation of the underwater well killing method for the extraction of hydrocarbons under uncontrolled fluid discharge conditions according to the present invention in operating phase;

FIG. 1*b* is an enlarged detail of FIG. 1*a;*

FIG. 2*a* is a perspective view of a constraint group used in the system according to the present invention in an open configuration;

FIG. 2*b* is an enlarged detail of FIG. 2*a;*

FIG. 3 is a schematic representation of the piloting system of the remote-operated vehicles used in the system according to the present invention;

Figures 1A, 1B:
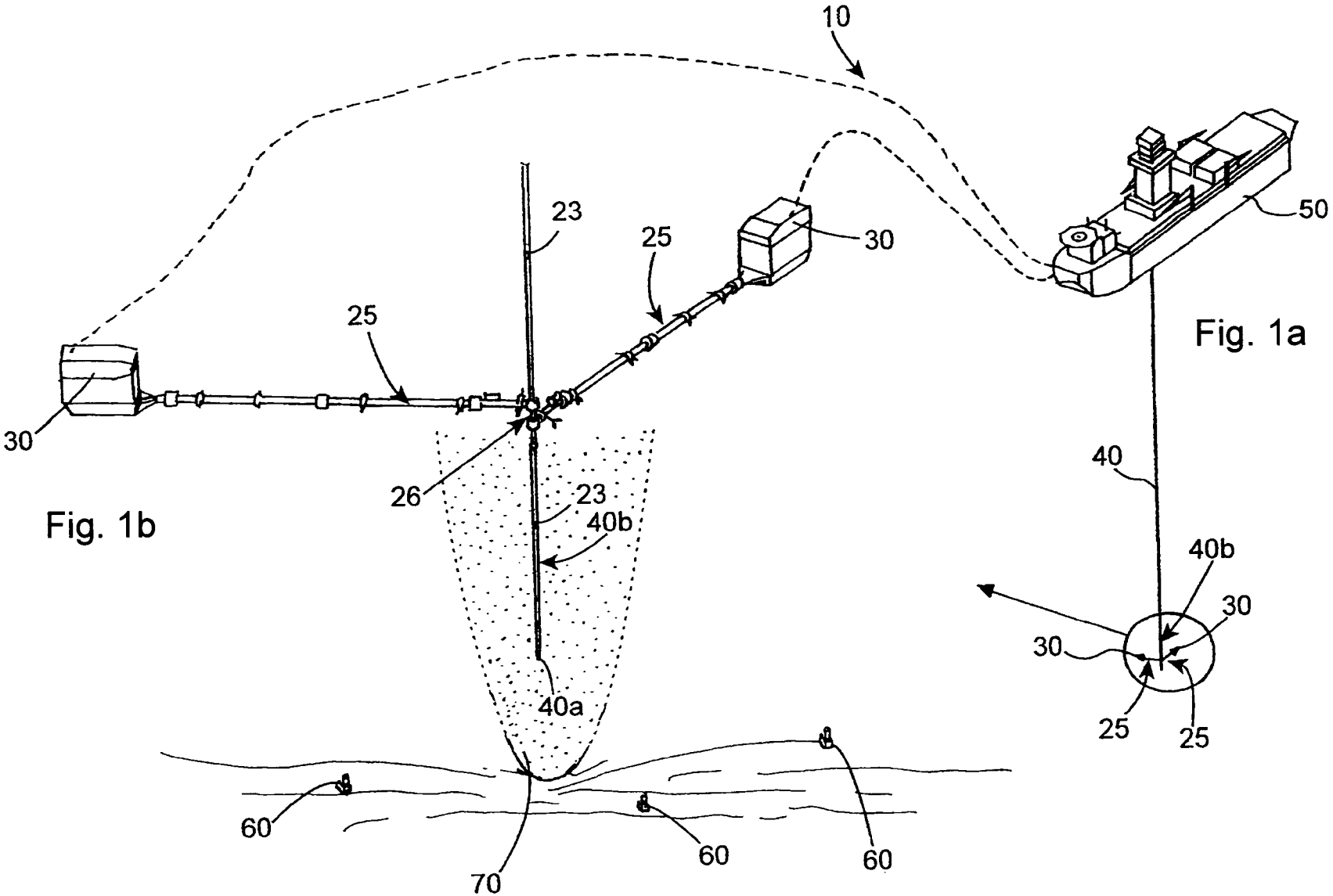
Figure 4:
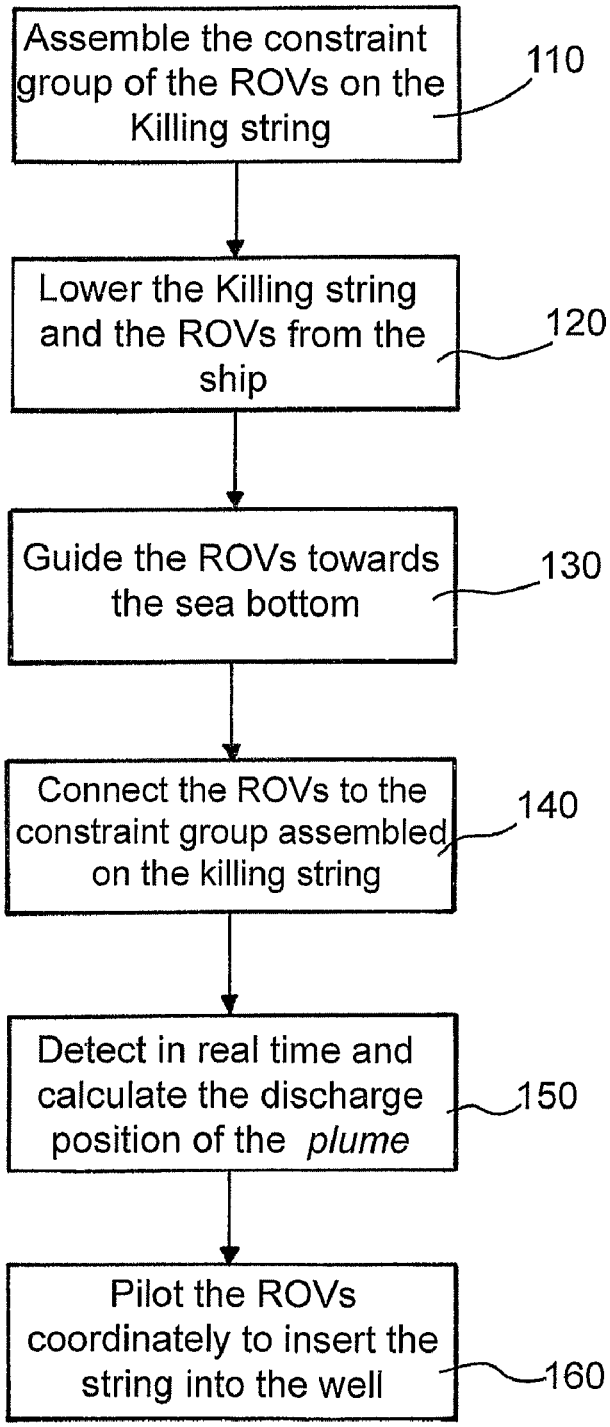
FIG. 4 is a block scheme of the underwater well 2Q killing method for the extraction of hydrocarbons under uncontrolled fluid discharge conditions according to the present invention.
Figure 5:
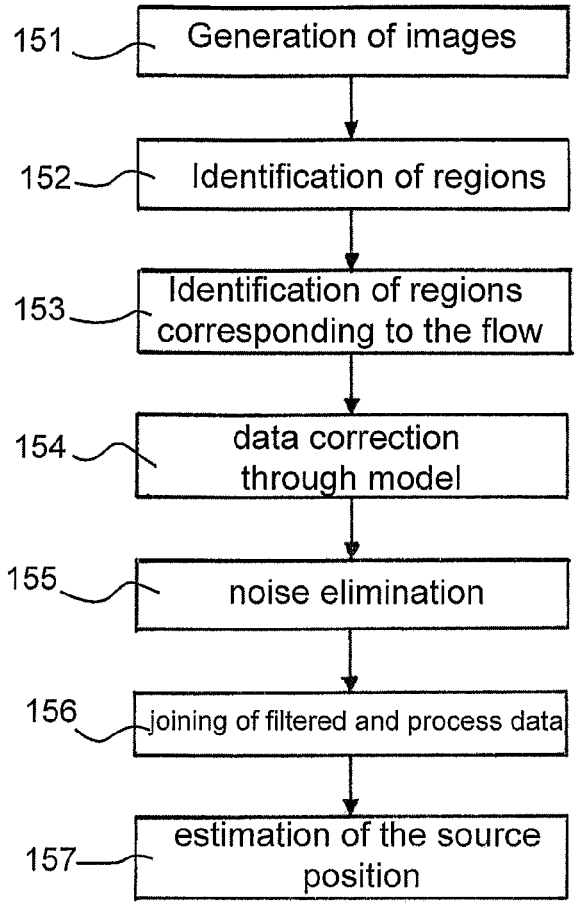
FIG. 5 is a block scheme of the steps of a first phase of the method of FIG. 4.
Figure 6:
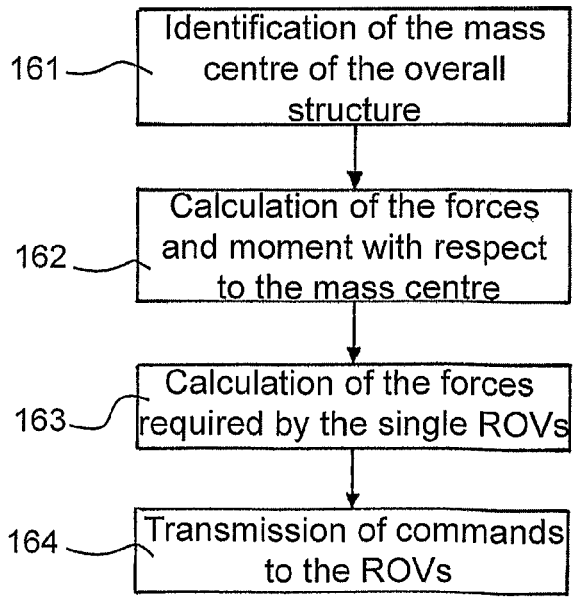
FIG. 6 is a block scheme of the steps of a second phase of the method of FIG. 4.

With reference to the figures, these show an extinction or killing system of an underwater well for the extraction of hydrocarbons under uncontrolled fluid discharge conditions, indicated as a whole with 10.

Said system 10 comprises a constraint group 20 to which a plurality of remote operated vehicles 30, also called ROV, is rigidly connected. This constraint group 20 comprises hooking means 26 to a string of pipes or killing string 40, to which at least two anchoring or docking arms 25 are connected.

In particular, the hooking means 26 are such as to be able to be constrained to the lower end portion 40*b* of the killing string 40 consisting of one or more drill pipes or drill collars. Preferably, the upper and lower interfaces of the drill pipes and collars are such as to be able to assemble other drill pipes and collars above and below them.

The hooking means 26 can be slidingly and rotatingly connected to the killing string 40. The sliding of the hooking means 26 is limited by mechanical end switches 23 present on the same string 40.

Said hooking means 26 are preferably produced by means of three rings 26*a*, 26*b* connected to each other in line by a plurality of rigid linear elements 26*c*.

The at least two anchoring or docking arms 25 are hinged onto the intermediate ring 26*a* so as to be able to have a closed position, substantially parallel to the killing string 40, and an open position, in which the docking arms 25 are arranged on a plane orthogonal to the string 40.

In a closed position, the constraint group 20 has such dimensions as to pass through a rotating board of the standard type normally used in drilling operations.

The opening of the docking arms 25 takes place in water at a pre-established depth. Said opening takes place automatically by the activation of a plurality of hydraulic cylinders 28 which guide the docking arms 25 in rotation to bring them from a closed to an open configuration.

The required hydraulic power is stored on the same equipment in hydraulic accumulators housed in the hooking means 26.

Once open, the docking arms 25 are blocked in position by the same cylinders 28.

The docking arms are equipped at their free end 25*a*, with a specific interface 29 of the known type for the hooking of a remote-operated vehicle or ROV 30.

The remote-operated vehicles 30 are each equipped with a compass 31 and an acoustic sensor 32 capable of determining the presence of obstacles and the distance from these through scanning in two directions with an acoustic signal and the subsequent analysis of the echo detected.

Said ROVs 30 are connected to a central processing unit 51 which allows the combined control of the vehicles 30, preferably positioned on a drill ship 50.

Through the connection to the ROVs 30, the processing unit 51 transmits suitable control signals to the digital communication input channels of the control systems of said ROVs 30 and receives, in input, the signals detected by the acoustic sensors 32 and the instantaneous orientation of the vehicles 30 determined by the compasses 31.

The processing unit 51 input is also connected to an acoustic positioning system 60, preferably of the transceiver type, situated at the sea bottom, which provides data on the position of the flow of hydrocarbons 70, and a plurality of sensors 41 situated on the lower end 40*a* of the killing string 40.

The acoustic positioning system 60 is preferably of the LBL (Long Base Line) type in which a plurality of transponders installed on the sea bottom reveals the measurement of the relative distances with respect to the drill ship 50.

The plurality of sensors 41 positioned on the lower end 40*a* of the killing string 40 is capable of verifying the correct insertion of the string 40 in the outlet hole of the plume 70 and therefore in the well.

The processing unit 51 comprises software means 56 which, on the basis of the input-data received, automatically determine the commands to be sent to the ROVs 30 according to the method discussed further on.

The processing unit 51 input is preferably also connected to a display interface 55 for the bidimensional and/or three-dimensional representation of the instantaneous position of the vehicles 30 and the killing string 40 with respect to the flow of fluids 70 and to an interface 52 for the entry of commands by an operator, such as for example a console with a joystick, to allow a manual control.

The functioning of the killing system 10 of an underwater well for the extraction of hydrocarbons under an uncontrolled fluid discharge condition according to the present invention is the following.

The constraint group 20 is assembled on the killing string 40, and in particular in correspondence with its lower end portion 40*b*, through the assembly of the hooking means 26 and the connection of the docking arms (25) (phase 110).

The killing string 40 is then lowered from the ship 50 in a conventional way, i.e. like a set of drill pipes, and on the basis of the information received from the acoustic system 60, positioned on the sea bottom so that its lower end 40*a* is close to the outlet hole of the fluid (phase 120).

The remote-operated vehicles 30 are in turn lowered from the ship 5Q (phase 120) up to the proximity to the sea bottom (phase 130) and piloted separately by an operator, for example through the standard command interface of the vehicles 30.

Once the docking arms 25 of the constraint group 20 have reached the proximity of the sea bottom, they are brought into an open position and the ROVs 30 are hooked to the first ends 25*a* of the same 25, through suitable means 29 (phase 140).

The plurality of ROVs 30 hooked to the constraint group 20 thus form an overall rigid structure 20, 30 which can be coordinately controlled through a combined control of the ROVs 30 (phase 160).

For this purpose, the position of the outlet hole of the flow of fluids 70 is first identified in real time through the information continuously revealed by the acoustic sensors 32 situated on the ROVs 30 (phase 150). For this purpose these sensors 32 are rigidly constrained on the ROVs 30 in order to maintain a reciprocal fixed position and be oriented towards a common detection area.

In an alternative embodiment, the identification phase 150 in real time of the position of the outlet hole can also be effected through a separate processing unit (not illustrated) which subsequently provides data to the processing unit 51 which determines and transmits the commands to the ROVs.

The identification of the position of the outlet hole of the flow of fluids 70 comprises the following steps.

The data coming from the plurality of sensors 32 are initially filtered to eliminate the overlying noise. For this purpose, bidimensional images are first created, only comprising points revealed by the sensors 32 with a greater intensity (phase 151). These images are then divided into detached regions through a process called segmentation which associates the homogeneous and contiguous portions of image with each other. A map is thus formed, which graphically represents a plurality of regions thus identified (phase 152) in order to isolate the representation areas of the plume 70 (phase 153).

This phase 153 is obtained by applying standard bidimensional algorithms to the image revealed by the sensors 32, such as for example growth algorithms of regions in connected components of the known type, and correcting the result obtained through geometrical information known a priori, such as for example the distance of the single sensors 32 with respect to structures revealed by the same and the substantially vertical direction of the axis of the plume 70.

So-called "Model Fitting" algorithms are applied to the regions thus identified in the image, which adapt these regions to geometries characteristic of the plume 70. In this way, it is possible to isolate and eliminate image points in the image which are recognized as non-characteristic of the image of the fluid flow since they do not belong to these characteristic geometries (phase 154).

For this purpose, the regions are initially projected in three-dimensional images and the main inertial axes are calculated to determine the geometrical form of the regions identified. In particular, the main axis of the flow itself is identified for the regions characteristic of the plume 70.

In order to eliminate incorrect information, due for example to acoustic noise and false echoes, with statistic filtering, a specific filtering algorithm is subsequently applied, such as the algorithm called Random Sample Consensus (RanSaC) known in literature (phase 155).

A processed three-dimensional image is thus obtained for each sensor 32 to identify, on the same image, the form of the flow of fluid 70. These however are still single isolated images.

As these three-dimensional isolated images are acquired according to stereoscopy theories for locating the flow of fluid 70 from different view points, whose reciprocal position is known, they must be subsequently joined to form a single stereoscopic image (phase 156).

For this purpose, an algorithm for joining the isolated images is applied, using the information on the reciprocal position of the sensors 32. A Euclidian point-to-point transformation of the points forming the surface of the fluid flow 70 in the image, is preferably used.

In this way, a single stereoscopic three-dimensional image of the surface of the plume 70 is obtained, with respect to a reference system situated on one of the sensors 32, with greater information on the curvature of said surface.

Finally an evaluation is effected of the geometrical form and dimensions of the flow of fluid present in the overall three-dimensional image obtained together with an estimation of the coordinates of the point of origin of the same (phase 157). For this purpose, intersection algorithms of the planes and vertical axis are applied to the stereoscopic image obtained to estimate the coordinates of the discharge point of the plume 70.

In particular, the intersection is estimated of a plane close to the outlet surface of the plume 70, such as for example the sea bottom, together with the main axis of the plume 70 identified in the previous processing phases.

Once the spill point of the flow of fluids 70 has been determined, the commands to be sent to the ROVs 30 are processed for piloting the lower end 40*a* of the string 40 towards this point.

Consequently, on the basis of the information on the position to be reached determined in phase 150 and instantaneous orientation of the single ROVs 14 which the processing unit 51 receives in input, the force and moment are calculated with respect to the mass centre of the overall structure 30, 20, previously defined (phase 161), necessary for effecting the required shift (phase 162).

On the basis of these data, the components of the forces which the single ROVs 30 must supply (phase 163) are determined through a metrical calculation and corresponding commands are transmitted to the ROVs (phase 164).

The killing method of an underwater well according to the present invention is thus capable of maintaining the lower end of the killing string 40 above the vertical of the well in blowout to allow its insertion contrasting dynamic disturbances due to currents, ship positioning errors and thrusts of the plume.

Once the lower end 40*a* of the killing string 40 has been brought and held above the vertical of the well entering the plume, the string 40 is inserted from the ship 50 into the uncontrolled fluid discharge outlet hole for the depth necessary for effecting the most appropriate killing strategy.

The sensors 41 assembled on the lower end 40*a* of the same, ensure that the head of the killing string 40 is effectively completely inside the plume and can therefore be lowered into the well without getting damaged.

The characteristics of the system and method, object of the present invention, as well as the related advantages, are clear from the description.

The use of a plurality of acoustic sensors assembled on the remote-operated vehicles and the subsequent stereoscopic processing of the data revealed offers the necessary precision for the reinsertion of the killing string into the well.

Furthermore, thanks to the use of the plurality of ROVs rigidly constrained to each other through the constraint group according to the invention, the guiding of the string is extremely simplified by the possibility of piloting it in a coordinated manner.

As a result of the constraint group, the ROVs can be kept far from the plume ensuring their maneuverability out of turbulences and reducing the risk of damage to the instruments used for the killing of the well.

For guiding the killing string, it is possible to use two or more work class type ROVs, which are generally already present onboard the most modern drill ships, using their propellers for guiding the string.

In addition, the sensors situated on the tip of the killing string allow the guided insertion of the same into the well without damage.

It is therefore possible to rapidly intervene on an underwater well in blowout by guiding the killing string into the well, also in the case of deepwater well and therefore in the presence of a drill ship with dynamic positioning.

If necessary, in relation to the depth and sea currents, with the system according to the invention, it is possible to also maintain the ship outside the vertical of the well, in a suitable position, to increase the safety of the operation.

Finally, it is evident that the system thus conceived can undergo several modifications and variants, all included in the invention; furthermore, all the details can be substituted with technically equivalent elements. In practice, the materials used, as also the dimensions, can vary according to technical requirements.

The invention claimed is:

1. A method for extinction of an underwater well for extracting a hydrocarbon under uncontrolled fluid discharge conditions, the method comprising:

a) assembling, in correspondence with a lower end portion of a killing string of pipes for the extinction, a constraint group for a rigid connection between a plurality of remote-operated underwater vehicles and said killing string;

b) revealing a position of a flow of fluids and positioning said killing string substantially in correspondence with said flow;

c) lowering the plurality of remote operated vehicles close to said lower end portion of said killing string;

d) connecting said remote operated vehicles to said constraint group;

e) detecting, in real time, a relative position of said flow of fluids with respect to said vehicles and calculating a position of an outlet hole of said flow;

f) on the basis of said calculated position of the outlet hole, coordinatedly piloting said vehicles so as to bring a lower end of said killing string in correspondence with said position of the outlet hole of said flow.

2. The method according to claim 1, further comprising:

g) once said outlet hole of said flow has been reached, detecting the position of said lower end of said killing string with respect to said outlet hole;

h) on the basis of position data revealed, modifying a position of said killing string to allow its insertion into said outlet hole.

3. The method according to claim 1, wherein said assembling of a constraint group to said killing string comprises assembling hooking unit on said killing string and connecting a plurality of docking arms to said hooking unit.

4. The method according to claim 3, further comprising, during the revealing b) of said killing string, bringing said plurality of docking arms from a closed position, in which said arms are arranged substantially parallel to said killing string, to an open position, in which said arms are arranged on a plane orthogonal to said killing string.

5. The method according to claim 1 wherein the detecting e) comprises:

e1) filtering and processing data coming from a plurality of acoustic sensors situated on said plurality of remote operated vehicles so as to obtain a plurality of single three-dimensional images of said flow of fluids;

e2) forming a single stereoscopic image through joining said plurality of single three-dimensional images;

e3) estimating the position of the outlet hole of said flow based on said stereoscopic image.

6. The method according to claim 5, wherein said filtering and processing of the data revealed comprises:

e1a) generating a bidimensional image consisting of points revealed having a greater intensity;

e1b) dividing said bidimensional image into detached regions by joining portions of homogeneous and contiguous images;

e1c) identifying among said detached regions, identified regions representing said flow of hydrocarbons;

e1d) projecting the identified regions in a three-dimensional image and determining its geometrical form;

e1f) reducing acoustic noise comprised in said three-dimensional image by statistical filtering.

7. The method according to claim 1, wherein said coordinatedly piloting f) comprises:

f1) determining a mass center of a structure comprising said plurality of remote operated vehicles and said constraint group;

f2) based on a relative position of said flow of fluids with respect to said vehicles and an orientation of said vehicles, determining the force and resulting moment, with respect to said mass center, necessary for reaching said position of the outlet hole of said flow;

f3) calculating components of forces required by individual vehicles by a matricial transformation of said force and said resulting moment with respect to the mass center and transmitting corresponding commands to said plurality of vehicles.

8. A system for extinction of an underwater well for the extraction of hydrocarbons under uncontrolled fluid discharge conditions, the system comprising:

a constraint group for the rigid connection between a plurality of remote operated underwater vehicles; and a killing string of pipes for the extinction, said constraint group comprising at least two docking arms arranged at a reciprocal fixed angular position, said docking arms comprising, at their free end, an interface which hooks one of said plurality of vehicles; and at least one acoustic sensor oriented towards a same detection area, being assembled on each of said plurality of vehicles.

9. The system according to claim 8, wherein said constraint group comprises a hooking unit which slidingly and rotatingly constrained to said killing string, said docking arms being are hinged to said hooking unit.

10. The system according to claim 9, wherein said hooking unit comprise a plurality of rings connected to each other in line by a plurality of rigid linear elements.

11. The system according to claims 9, wherein said constraint group also comprises a hydraulic cylinder for each docking arm, suitable for guiding said arm in rotation.

12. The system according to claim 8 wherein said hooking unit can be slidingly constrained to said killing string limitedly between two end switches.

13. The system according to claim 8, further comprising at least one processing unit connected to said plurality of vehicles suitable for calculating commands to be transmitted to said vehicles.

14. The system according to claim 8, wherein each of said plurality of vehicles is equipped with a compass.

15. The system according to claim 13, wherein said processing unit is connected to a plurality of sensors situated in correspondence with a lower end of said killing string.

* * * * *